US005078212A

United States Patent [19]

Boyle et al.

[11] Patent Number: 5,078,212

[45] Date of Patent: Jan. 7, 1992

[54] EMPLACEMENT OF FILTER PACKS AND SEALS FOR GROUNDWATER MONITORING

[75] Inventors: Daniel R. Boyle, Ottawa; Russell J. Thibedeau, Spencerville; Romeo Forconi, Nepean, all of Canada

[73] Assignee: Her Majesty the Queen in right of Canada, as represented by the Minister of Energy, Mines and Resources, Ottawa, Canada

[21] Appl. No.: 578,298

[22] Filed: Sep. 6, 1990

[30] Foreign Application Priority Data

Sep. 8, 1989 [CA] Canada ..... 610848

[51] Int. Cl.[5] ..... E21B 43/04

[52] U.S. Cl. ..... 166/278; 166/51; 166/90

[58] Field of Search ..... 166/276, 278, 290, 313, 166/51, 67, 90

[56] References Cited

U.S. PATENT DOCUMENTS

| | | | |
|---|---|---|---|
| 1,980,632 | 11/1934 | Peeples | 166/278 |
| 2,014,770 | 9/1935 | Layne | 166/51 |
| 2,626,779 | 1/1953 | Armentrout | 166/278 |
| 2,749,988 | 6/1956 | West | 166/278 |
| 2,786,531 | 3/1957 | Mangold et al. | 166/276 |
| 4,028,009 | 6/1977 | Gudzenko et al. | 166/51 |
| 4,944,347 | 7/1990 | Richard et al. | 166/278 |

FOREIGN PATENT DOCUMENTS

| | | | |
|---|---|---|---|
| 1406348 | 6/1988 | U.S.S.R. | 166/276 |
| 1413240 | 7/1988 | U.S.S.R. | 166/51 |
| 1425305 | 9/1988 | U.S.S.R. | 166/51 |

*Primary Examiner*—Hoang C. Dang

*Attorney, Agent, or Firm*—Alan A. Thomson; Ronald G. Bitner

[57] ABSTRACT

A method and apparatus for emplacement of dry particulate filter pack and seal material into a borehole to form a monitoring zone for groundwater monitoring which allows the material to be emplaced in dry form. The method involves inserting a tube into the borehole to a depth above a desired monitoring zone and consecutively injecting a first layer of seal material, a layer of filter material and a second layer of seal material, while supplying gas to the tube to prevent groundwater from contacting particulate material while in the tube. The apparatus comprises an injector, including a container and valve assembly adapted for connection to a pressurized gas supply, that allows sequential placement of seal material and filter material while continuously supplying gas to the injection tube.

8 Claims, 1 Drawing Sheet

EMPLACEMENT OF FILTER PACKS AND SEALS FOR GROUNDWATER MONITORING

FIELD OF THE INVENTION

This invention relates to the emplacement of particulate filter pack and seal material into a borehole to form a monitoring zone for groundwater monitoring.

BACKGROUND OF THE INVENTION

Groundwater monitoring requires accurate and uniform emplacement of filter packs and seals during construction of the groundwater monitoring well in order to obtain confident representative groundwater samples and hydrological data. A proper installation system must ensure that bridging of filter pack and seal materials does not occur, particularly when installing multilevel groundwater monitoring systems.

Presently, emplacement of filter packs and seals is carried out by one of three methods: One method involves pouring materials down the annulus of the monitoring well system, followed by tamping. This method is restricted to shallow installations in large holes with small diameter wells. A second method involves continuous pouring of materials down a tremie pipe while withdrawing pipe sections. This method is very time consuming and prone to clogging. It requires at least a 1.5 inch inside diameter pipe which places restrictions on hole size and depth. A third method involves pumping of a slurry of the seal material down the hole which requires mixing and pumping equipment with special high-solids grouting materials. Also, contamination of the filter pack is common with this method.

SUMMARY OF THE INVENTION

It has been found that filter pack and seal material can be accurately and conveniently emplaced in dry form using the method and apparatus of the present invention.

The present invention provides a method of emplacing particulate filter pack and seal material into a borehole to form a monitoring zone for groundwater monitoring comprising: inserting a tube into the borehole to a depth above a desired monitoring zone; supplying gas to said injection tube to maintain it free of groundwater while forming a monitoring zone; injecting selected particulate material through said tube along with the gas to deposit consecutively a first layer of seal material, a layer of filter material and a second seal layer, to form the monitoring zone.

The present invention provides an apparatus for emplacement of particulate filter pack and seal material into a borehole to form a monitoring zone for groundwater monitoring comprising: a sealable container having inlet means for receiving particulate material, and an outlet for the material at a lower end of the container; a valve assembly for controlling the egress of particulate material, said valve assembly comprising a valve member, a valve seat, a valve shaft and valve actuating means, said valve member, valve shaft and valve actuating means being operatively interconnected to provide releasable seating of the valve member onto the valve seat; the valve seat being operatively associated with the outlet to prevent egress of particulate material when engaged by the valve member; the valve shaft and valve member each having an interconnecting passageway therein, the valve shaft having inlet means for connecting the passageway with a supply of pressurised gas, and wherein the passageway in the valve member provides a passageway for gas to the outlet when the valve member engages the valve seat, operative such that gas can be supplied continuously at the outlet while egress of particulate material is independently controlled by selectively seating or unseating the valve member with respect to the valve seat.

DESCRIPTION OF THE PREFERRED EMBODIMENTS

Figure 1:
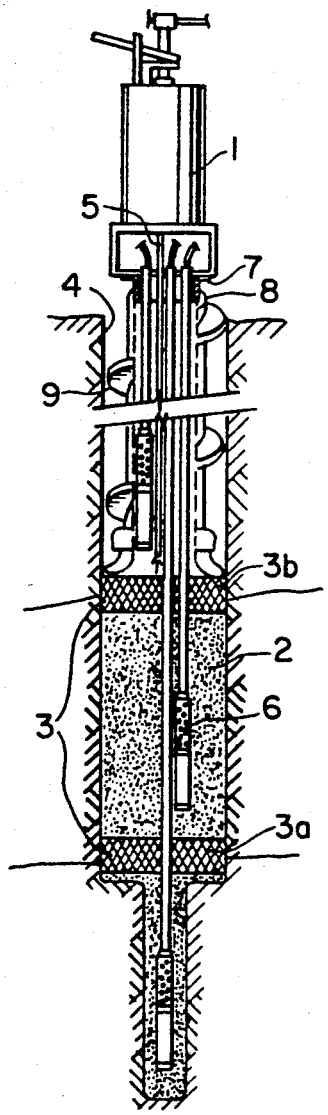
FIG. 1 is a schematic representation of an elevation of a drill hole illustrating installation of filter pack and seal material for groundwater monitoring in accordance with the present invention.

With reference to FIG. 1, the present invention involves the use of an injector 1 (detailed in FIG. 2) for emplacing particulate filter pack material 2 and seal material 3 into a borehole 4 to form a monitoring zone. The material is conveyed from the injector 1 through an injection tube 5. FIG. 1 shows a monitoring device 6, which may for example be a piezometer, installed in the filter pack 2.

Figure 2:
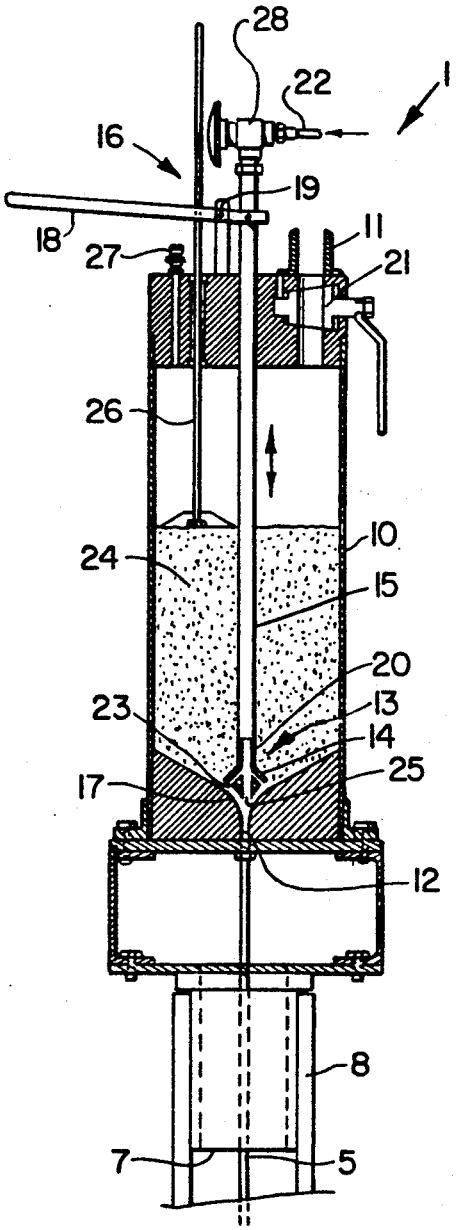
FIG. 2 is an enlarged cross-sectional view of the material injection device shown in FIG. 1.

Referring to FIGS. 1 and 2, the injector 1 comprises a container 10, having a sealable inlet 11 for particulate material 24, an outlet 12, and a valve assembly 13. The inlet 11 will preferably be provided with a valve 21 to facilitate refilling of the container 10 and provide closure during the injection operation. The injector 1 is provided with a suitable adapter 7 for connecting with the casing 8, which in FIG. 1 is shown as part of a hollow stem auger 9.

The valve assembly 13 comprises a valve member 14, a valve shaft 15 and valve actuating means 16. The valve seat 17 for the valve 14 is integrally associated with the outlet 12.

The valve actuating means 16, shown as a lever 18 pivotally mounted at 19, provides for opening and closing (raising and lowering) of the valve member 14 with respect to the valve seat 17.

The valve member 14 and valve shaft 15 have an interconnecting passageway 20 for connection with a source of pressurized gas, such as air or an inert gas, supplied to inlet 22 and controlled by valve 28. It will be noted that the outlet 25 of passageway 20 communicates with the outlet 12, when the valve member 14 is closed onto seat 17. This arrangement allows for continuous supply of gas to outlet 12 while egress of particulate material can be independently controlled, as will be described.

The valve member 14 is preferably provided with a secondary outlet or outlets 23 to facilitate flow of the particulate material 24 from the container and to keep the valve seat 17 free of material. Outlets 23 are preferably skewed to provide rotation of flow. The geometry of these secondary outlets 23 and the valve seat 17 is designed such that gas flow from outlets 23 is blocked when the valve member 14 is seated onto seat 17. However, as indicated above, gas flow through outlet 25 can be maintained to injection tube 5 whether valve member 14 is seated or unseated with respect to seat 17.

Preferably the container 10 will be provided with a valve 27 that functions as a relief valve for releasing pressure from container 10 prior to opening valve 21 for refilling, and also as a vent while refilling.

The injection tube 5 will preferably be made of a flexible material. Tubing material found to be suitable was polypropylene or nylon having a diameter of ⅜ or ½ inch.

To facilitate injecting the correct amount of material for each layer, the container may be provided with a level indicator 26 for indicating the amount of material therein.

The injector can be used to inject the seal material, for example, Bentonite, in either granulated or powder form. Suitable filter pack materials are quartz or silica sand, agglomerated polytetrafluoroethylene or other granular plastic material.

In operation, with reference to both FIGS. 1 and 2, after mounting the monitoring device, or devices 6, into the borehole 4, and the injector onto the casing 8, as shown, the tube 5 is positioned to a suitable distance above the first monitoring zone. The valve 14 is closed and valve 27 is opened while particulate material 24 is introduced into the container 10 via the inlet 11. After the container is loaded with the selected material 24, valves 21 and 27 are closed. Opening valve 28 allows gas supplied to the inlet 22 to eject any groundwater that may have entered the tube 5. It should be noted that the gas supply valve 28 can remain open during the filling of the container since the gas being supplied is isolated from the container 10 due to the valve 14 being seated onto seat 17. Preferably, the gas flow will be maintained for the complete installation of a monitoring zone. However, gas flow can be interrupted provided gas is supplied to the tube before particulate material injection is begun and continued after material injection is terminated, to prevent groundwater from contacting particulate material while in the tube. As is known, a seal material, such as Bentonite, will swell on contact with water and is likely to clog the tube 5, if this should occur.

To inject material, the valve 14 is raised to separate it from seat 17. With valve 14 opened, material in the container 10 will be carried with the gas flowing from the outlet 25 of the passageway 20 through the outlet 12 and down the injection tube 5 to form one of the layers of a monitoring zone. This process is repeated to emplace consecutively the necessary layers of a monitoring zone, generally including a lower seal layer 3*a*, the filter layer 2 and the upper seal layer 3*b*. The tube 5 is raised as required so that the outlet is above the deposited material. Raising of the tube 5 is facilitated by the use of a flexible tube 5 which can be pulled upwardly, cut to the desired length and reattached to the outlet 12 of the container from the top. Providing additional monitoring zones will generally involve providing three layers for each monitoring zone. It should be noted however that two adjacent monitoring zones may share a common seal layer, as is shown in FIG. 1.

After completion of the monitoring zones, a top seal and well head casing can be installed in a conventional manner.

In FIG. 1 the present invention is shown used with a hollow-stem augering system. In this system the auger 9 is withdrawn in stages as a higher monitoring zone, or zones, are installed. It will be understood that the present invention may be used in other systems, for example, reverse circulation drilling, or casing advance and hammer drilling. For such other applications, suitable adapters (7) will be required for mounting the injector on the particular casing.

It will also be understood that the operation of the injector could be automated and that the means for actuating various elements such as the valve member 14, valve 21 and valve 27 could be provided by other mechanisms, for example using pneumatic or electrical actuators.

What is claimed is:

1. A method for emplacement of dry particulate filter pack and seal material into a borehole to form a monitoring zone for groundwater monitoring comprising:

inserting a tube into the borehole to a depth above a desired monitoring zone;

supplying gas to said tube to maintain it free of groundwater while forming a monitoring zone;

injecting selected particulate material through said tube along with the gas to deposit consecutively a first layer of seal material, a layer of filter material and a second seal layer, to form the monitoring zone.

2. The method of claim 1 wherein gas is supplied to the tube before particulate material injection is begun and continued after material injection is terminated to prevent groundwater from contacting particulate material while in the tube.

3. The method of claim 1, comprising sequentially installing a plurality of monitoring zones.

4. A method for emplacement of dry particulate filter pack and seal material into a borehole to form a monitoring zone for groundwater monitoring comprising:

providing injection means, comprising a container for particulate material and a valve assembly for selectively supplying a gas, or a gas with particulate material;

inserting a tube connected with said injection means into the bore hole to a depth above a desired monitoring zone;

supplying gas to the tube to maintain it free of groundwater while forming a monitoring zone; and consecutively injecting a first layer of seal material, a layer of filter material and a second seal layer with the gas supply, to form the monitoring zone.

5. The method of claim 4 wherein gas is supplied to the tube before particulate material injection is begun and continued after material injection is terminated to prevent groundwater from contacting particulate material while in the tube.

6. An apparatus for emplacement of particulate filter pack and seal material into a borehole to form a monitoring zone for groundwater monitoring comprising:

a container having inlet means for receiving particulate material, and an outlet for the material at a lower end of the container;

a valve assembly for controlling the egress of particulate material, said valve assembly comprising a valve member, a valve seat, a valve shaft and valve actuating means, said valve member, valve shaft and valve actuating means being operatively interconnected to provide releasable seating of the valve member onto the valve seat;

the valve seat being operatively associated with the outlet to prevent egress of particulate material when engaged by the valve member;

the valve shaft and valve member each having an interconnecting passageway therein, the valve shaft having inlet means for connecting the passageway with a supply of pressurised gas, and wherein the passageway in the valve member provides a passageway for gas to the outlet when the valve member engages the valve seat, operative such that gas can be supplied continuously at the outlet while egress of particulate material is independently controlled by selectively seating or unseating the valve member with respect to the valve seat.

7. The apparatus of claim 6 further comprising a flexible tube for connection with said outlet and extending to a region above which material is to be deposited.

8. The apparatus of claim 6 further comprising valve means associated with said container to provide selective venting to outside of the container.

* * * * *